United States Patent [19]

Siemund

[11] 4,075,730

[45] Feb. 28, 1978

[54] NON-METALLIC SQUEEGEE FOR SHOWERBATH SURFACES AND THE LIKE

[75] Inventor: Herbert A. Siemund, Chicago, Ill.

[73] Assignee: Greenview Manufacturing Company, Chicago, Ill.

[21] Appl. No.: 724,607

[22] Filed: Sep. 20, 1976

[51] Int. Cl.[2] ..... A47L 1/08; A47L 13/11

[52] U.S. Cl. ..... 15/245; 15/250.36

[58] Field of Search ..... 15/117, 121, 245, 250.36, 15/250.42; D7/181, 184

[56] References Cited

U.S. PATENT DOCUMENTS

| | | | |
|---|---|---|---|
| 701,278 | 6/1902 | Adcock | 15/245 X |
| 1,801,915 | 4/1931 | Gray | 15/244 R |
| 2,563,940 | 8/1951 | Krasberg | 15/105 |
| 2,586,472 | 2/1952 | McKown | 15/245 X |
| 3,116,506 | 1/1964 | Browne et al. | 15/250.36 |
| 3,766,591 | 10/1973 | Soito | 15/245 |

FOREIGN PATENT DOCUMENTS

| | | | |
|---|---|---|---|
| 42,869 | 11/1970 | Finland | 15/245 |
| 558,657 | 8/1923 | France | 15/245 |

*Primary Examiner*—Daniel Blum

*Attorney, Agent, or Firm*—Silverman & Cass

[57] ABSTRACT

Squeegee construction for showerbath surfaces which is water impervious. The squeegee construction comprises a hollow, relatively rigid, plastic T-shaped handle mounting an extruded integral squeegee that is formed of two different durometers of plastic material. A rigid backbone portion engages in between rigid non-spreadable jaws defined by an elongate groove formed in the crossbar portion of the handle requiring an endwise entry and an elastomeric squeegee blade protrudes from the crossbar to provide the squeegee function. The squeegee is secured by means of protrusions extending from the rigid backbone into openings formed in the crossbar portion of the handle.

3 Claims, 3 Drawing Figures

NON-METALLIC SQUEEGEE FOR SHOWERBATH SURFACES AND THE LIKE

FIELD OF THE INVENTION AND BACKGROUND

Showerbath surfaces of tile or plastic must be wiped down to prevent waterspots, mildew or scum. Conventional squeegees have metal parts which rust and stain if subject to moisture or if permitted to remain in the damp atmosphere of the bathroom or the like.

The invention provides a squeegee construction which is fully non-metallic; which is made of only two pieces; which is highly economical and yet effective to clean showerbath surfaces and the like; which is extremely light weight and yet robust; which can be permitted to remain in the showerbath without rusting or staining; which need not be thoroughly dried after use.

SUMMARY OF THE INVENTION

Squeegee for showerbath surfaces comprising a T-shaped hollow handle of plastic mounting a blade having a rigid backbone part and an elastomeric scraper portion, the rigid backbone portion being mounted in an elongate groove formed in the crossbar portion of the T-shaped handle with the scraper portion protruding and free to flex. Upset protrusions extending from the rigid backbone portion into sockets in the crossbar portion hold the device in assembly.

DESCRIPTION OF THE PREFERRED EMBODIMENT

Figure 1:
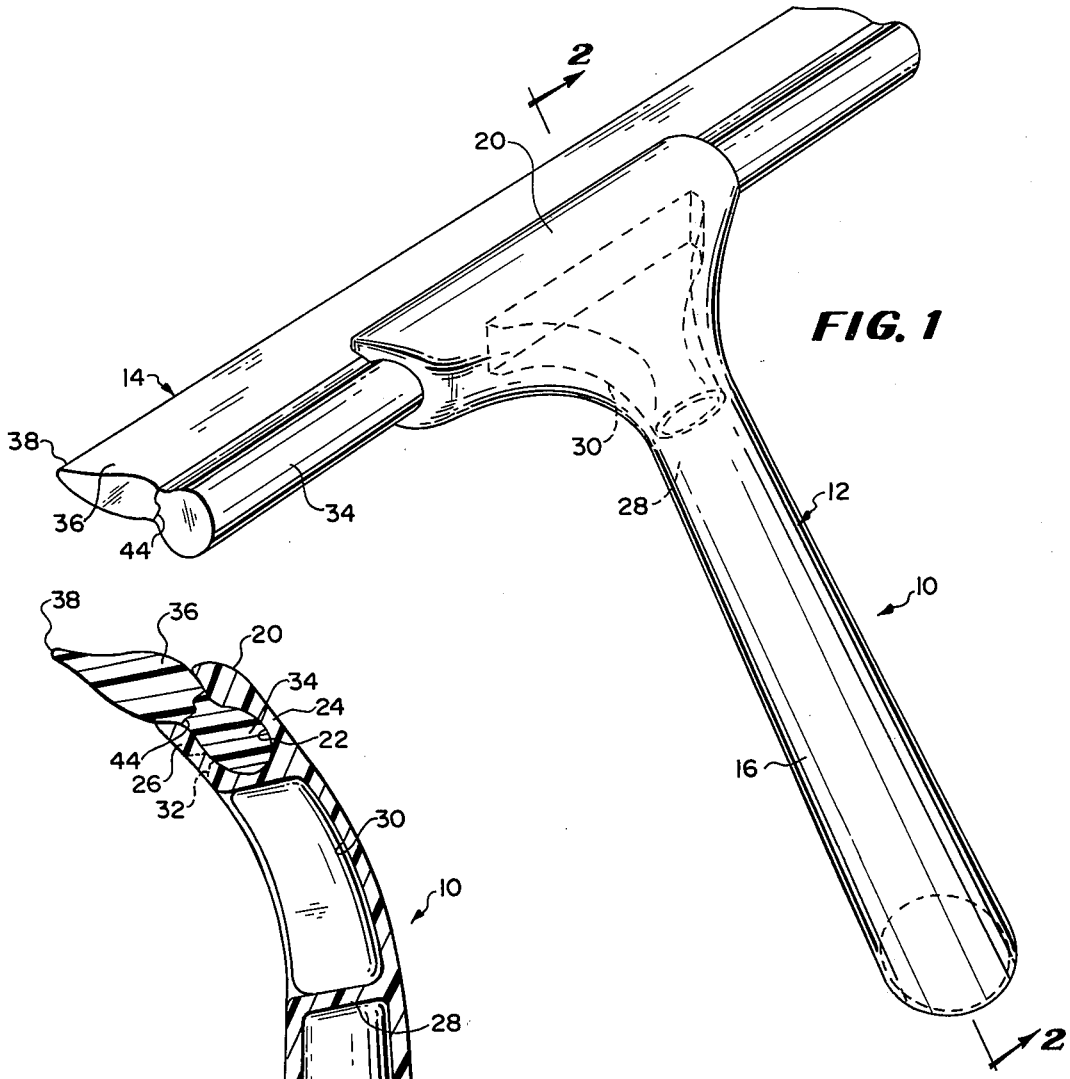
FIG. 1 is a perspective view of a squeegee construction constructed in accordance with the invention.
Figure 2:
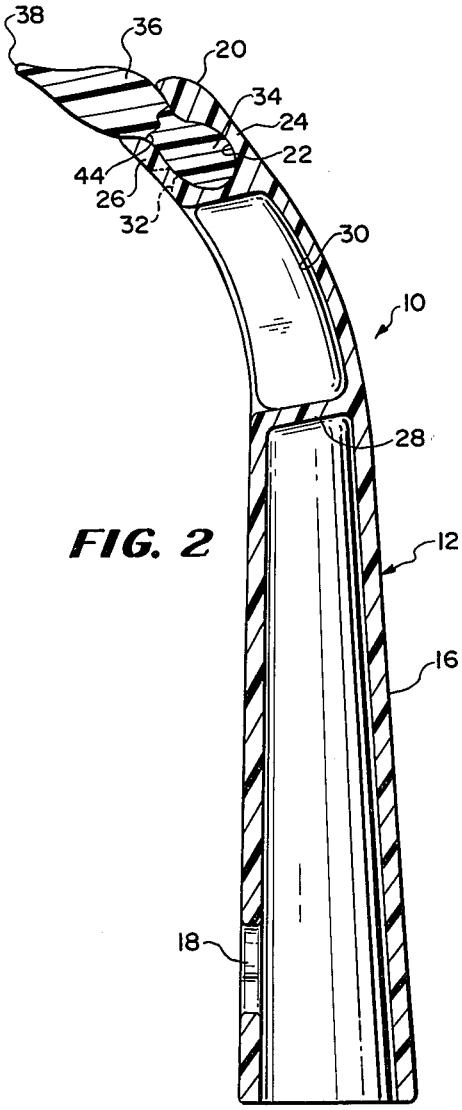
FIG. 2 is a sectional view taken generally along the line 2—2 of FIG. 1 and in the indicated direction.
Figure 3:
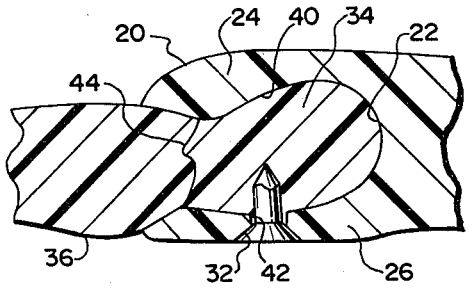
FIG. 3 is an enlarged fragmentary transverse sectional detail of Fig 2.

The squeegee construction 10 of the invention is formed of two parts which are secured together, these being a T-shaped handle 12 and a squeegee 14.

The T-shaped handle 12 is of known construction, per se, and has been used to produce squeegee constructions having metal parts. It is formed of molded synthetic resin or plastic of any suitable kind such as for example relatively rigid nylon, methacrylates, or the like. There is a grip portion 16 that is hollow and has a hole at 18 for enabling the device 10 to be hung on a suitable hook. The handle 12 has an integrally molded crossbar part 20 that has a uniform generally undercut groove 22 formed along its length thereby providing non-spreadable upper and lower jaws 24 and 26, respectively. A strengthening transverse web 28 separates an upper hollow chamber 30 from the grip portion 16 so that the handle is light in weight and economical of material.

The handle 12 has one or more countersunk sockets 32 formed in the lower jaw to accommodate metal screws or rivets that are intended to hold a metal-backed squeegee in the groove when the handle is used for its originally intended purpose. The identical handle has been adapted for use with the invention herein without change, but in a structure that uses no metal fasteners or metal squeegee parts.

The squeegee 14 is an integral extruded member which is made in lengths and cut to size for insertion into the groove 22. There is a rigid backbone part 34 that has a cross-sectional configuration that accurately conforms on its exterior with the interior configuration of the groove 22. There is a squeegee blade 36 that tapers to a thin tip 38 formed of an elastomeric material having sufficient flexibility to give the squeegee action desired in use. The squeegee blade 36 is dimensioned to protrude for a substantial distance beyond the ends of the jaws 24 and 26 to enable flexing thereof during use. For example, in a practical device, the distance from the rearmost end of the rigid backbone portion 34 to the tip 38 was about 3 centimeters and the portion which protruded beyond the jaw ends was about half of that. The practical device had a blade that was somewhat less than 20 centimeters in length for ease in handling by a housewife, but longer blades are feasible. The length of the crossbar 20 was about 8 centimeters.

The groove 22 has been described as undercut, meaning that it is larger in diameter in its interior than at its entrance so that there is a throat at 40 to resist directly outward withdrawal of the squeegee 14 from the handle 12 during use. The squeegee 14 is installed in the groove 22 by sliding the same in from one end of the crossbar part 20 of the handle 12. After this assembly, a thin heated metal pin of a diameter smaller than that of the narrower diameter of the socket 32 is pressed through the socket 32 into the rigid plastic of the backbone 34 softening the plastic and extruding the same in a sort of flash extending back up the sides of the pin and into the socket 32. The pin is withdrawn leaving a small protrusion 42 acting as a rivet. Since the only force capable of separating the squeegee 14 from the jaws 24, 26 is an endwise sliding force, and since the backbone portion 34 closely conforms to the groove 22, a slight obstruction such as one or two of such protrusions 42 is sufficient to lock the device 10 in assembly.

The squeegee 14 can be made of a suitable synthetic resin such as polyvinyl chloride which can be extruded in a dualdurometer technique as an integral member. This technique per se is known, as for example, in the manufacture of extruded gaskets for refrigerators and the like. In the practical example of the invention, the plastic of the backbone portion 34 was polyvinylchloride (PVC) of 78 durometer measured on the D scale and the plastic of the squeegee blade 36 was also polyvinylchloride (PVC) but of 70 durometer on the A scale. The use of the identical synthetic resin gave compatability and hence excellent adhesion at the junction 44 of the two parts while the backbone part remained rigid enough to be self-supporting and the squeegee blade 36 was as flexible and resilient as soft rubber.

The relative curvature of the squeegee 14 in cross section is chosen to provide with the handle 10 or any other design of handle the proper angle for efficient squeegeeing of a surface.

Modifications are feasible without departing from the spirit or scope of the invention as defined in the appended claims.

What is desired to secure by Letters Patent of the United States is:

1. A squeegee construction comprising a relatively rigid plastic handle of T-shaped configuration providing a gripping portion and a crossbar, said crossbar having upper and lower rigid non-spreadable jaws defined by an undercut groove of a particular internal configuration along the entire length of said crossbar, an integral extruded squeegee mounted in said crossbar jaws, said squeegee formed of a synthetic plastic resin, said squeegee having a rigid backbone of cross-sectional configuration capable matingly to engage within said undercut groove but requiring an endwise entry and sliding movement to effect such engagement, said squeegee further having a flexible and resilient squeegee blade of synthetic plastic resin connected with said backbone along one edge thereof at a junction which provides for substantial portion of the squeegee blade to extend laterally of an be free to flex relative to the crossbar, said squeegee blade being of a durometer hardness which is substantially different from the durometer hardness of the backbone part such that said squeegee blade is elastomeric in character, the length of said squeegee blade and backbone being substantially greater than the length of the crossbar jaws, the squeegee extending beyond the ends of the jaws, the backbone supporting the squeegee blade sections extending beyond the crossbar, and means on the crossbar and backbone preventing endwise disengagement of the squeegee.

2. The invention as claimed in claim 1 in which the backbone and the squeegee blade are formed of the same synthetic resin albeit of different durometer hardness.

3. The invention as claimed in claim 1 in which the last mentioned means includes socket means on the crossbar opening to the interior of the groove and protrusion means integral with the backbone extending into said socket means from the interior of said groove when the backbone is installed between the jaws of said crossbar.

* * * * *

UNITED STATES PATENT AND TRADEMARK OFFICE

CERTIFICATE OF CORRECTION

PATENT NO. : 4,075,730

DATED : February 28, 1978

INVENTOR(S) : HERBERT A. SIEMUND

It is certified that error appears in the above-identified patent and that said Letters Patent are hereby corrected as shown below:

Column 3, line 9, change "an" to -- and --.

Signed and Sealed this

*Thirtieth* Day of *May 1978*

[SEAL]

*Attest:*

RUTH C. MASON
*Attesting Officer*

LUTRELLE F. PARKER
*Acting Commissioner of Patents and Trademarks*